US009357592B2

(12) United States Patent
Basauri

(10) Patent No.: US 9,357,592 B2
(45) Date of Patent: May 31, 2016

(54) LIGHT SOURCE TEMPERATURE MONITOR AND CONTROL

(75) Inventor: Alejandro V. Basauri, Beaverton, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 708 days.

(21) Appl. No.: 12/949,694

(22) Filed: Nov. 18, 2010

(65) Prior Publication Data

US 2012/0126702 A1 May 24, 2012

(51) Int. Cl.
*H05B 33/08* (2006.01)

(52) U.S. Cl.
CPC ..... *H05B 33/0803* (2013.01); *H05B 33/089* (2013.01); *H05B 33/0854* (2013.01); *H05B 33/0815* (2013.01); *H05B 33/0869* (2013.01)

(58) Field of Classification Search
CPC ..... H01L 23/3675
USPC ..... 315/247, 307–326, 185 S, 49–56, 315/149–158
See application file for complete search history.

(56) References Cited

U.S. PATENT DOCUMENTS 3,530,452 A * 9/1970 Jan ..... 340/594
5,857,767 A 1/1999 Hochstein
5,936,353 A 8/1999 Triner et al.
6,200,134 B1 3/2001 Kovac et al.
6,457,823 B1 10/2002 Cleary et al.
6,477,047 B1 * 11/2002 Markwardt et al. ..... 361/704
6,501,084 B1 12/2002 Sakai et al.
6,683,421 B1 1/2004 Kennedy et al.
6,692,250 B1 2/2004 Decaudin et al.
6,876,785 B1 4/2005 Li et al.
7,635,957 B2 * 12/2009 Tripathi et al. ..... 315/309
7,821,123 B2 * 10/2010 Oman ..... 257/706

(Continued)

FOREIGN PATENT DOCUMENTS

DE 19619154 A1 6/1997
DE 10127171 A1 12/2001

(Continued)

OTHER PUBLICATIONS

Nichia: Application Note: Thermal management design of LEDs, LAKSE3110C, Oct. 31, 2003.*

(Continued)

*Primary Examiner* — Tuyet Vo
(74) *Attorney, Agent, or Firm* — Alleman Hall McCoy Russell & Tuttle LLP

(57) ABSTRACT

A light source comprising a light emitter; a heat sink coupled to the light emitter; and a temperature sensor substantially adjacent to the light emitter. A first thermal time constant associated with the temperature sensor is less than a second thermal time constant associated with a radiation surface of the heat sink.

13 Claims, 4 Drawing Sheets

(56) References Cited

U.S. PATENT DOCUMENTS

| | | | | |
|---|---|---|---|---|
| 2001/0046652 | A1 | 11/2001 | Ostler et al. | |
| 2002/0187454 | A1 | 12/2002 | Melikechi et al. | |
| 2003/0043582 | A1 | 3/2003 | Chan et al. | |
| 2003/0081096 | A1 | 5/2003 | Young | |
| 2007/0013322 | A1* | 1/2007 | Tripathi et al. | 315/291 |
| 2007/0057267 | A1* | 3/2007 | Oman | 257/95 |
| 2007/0273290 | A1* | 11/2007 | Ashdown et al. | 315/113 |
| 2008/0136331 | A1* | 6/2008 | Schmeikal | 315/32 |
| 2009/0189549 | A1* | 7/2009 | Crawford et al. | 315/309 |
| 2009/0278034 | A1* | 11/2009 | Ackermann et al. | 250/227.11 |

FOREIGN PATENT DOCUMENTS

| | | | |
|---|---|---|---|
| EP | 0879582 | A1 | 11/1998 |
| EP | 1158761 | A1 | 11/2001 |
| EP | 1599340 | B1 | 9/2007 |
| WO | 9507731 | A1 | 3/1995 |
| WO | 0059671 | A1 | 10/2000 |
| WO | 0067048 | A2 | 11/2000 |
| WO | 0211640 | A2 | 2/2002 |
| WO | 0213231 | A2 | 2/2002 |
| WO | 03023875 | A2 | 3/2003 |

OTHER PUBLICATIONS

ISA US, International Search Report of PCT/US20111061468, Mar. 21, 2012, WIPO, 2 pages.

ISA US, Written Opinion of PCT/US20111061468, Mar. 21, 2012, WIPO, 5 pages.

Data Sheet for G*SiC Technology Super Blue LEDs No. C430-CB290-E1200, manufactured by Opto Semiconductors, May 1, 1999, 8 pages.

Data Sheet for 5.0 mm Blue Series LEDs No. LNG992CFB, manufactured by the Panasonic Corporation, Mar. 2001, 1 page.

Data Sheet for 3.0 mm Blue Series LEDs No. LNG997CKB, manufactured by the Panasonic Corporation, Mar. 2001, 1 page.

Data Sheet for G*SiC Technology Ultraviolet LEDs No. C395-MB290-E0400, manufactured by Cree, Inc., 2 pages.

* cited by examiner

LIGHT SOURCE TEMPERATURE MONITOR AND CONTROL

BACKGROUND

This disclosure relates to light sources and, in particular to monitoring and/or control of temperatures of light sources.

Light sources are used for a variety of applications. For example, light sources can be used to cure inks, coatings, adhesives, or the like. The generation of the light can be accompanied by a generation of a significant amount of heat. A heat sink can be disposed on the light source to remove heat. However, a failure can cause the light source to increase in temperature beyond a threshold above which the light source can be damaged.

DETAILED DESCRIPTION

Embodiments will be described with reference to the drawings. In particular, in an embodiment, a temperature sensor is disposed in a light source such that the temperature sensor has a reduced thermal time constant relative to a light emitter.

Figure 1:
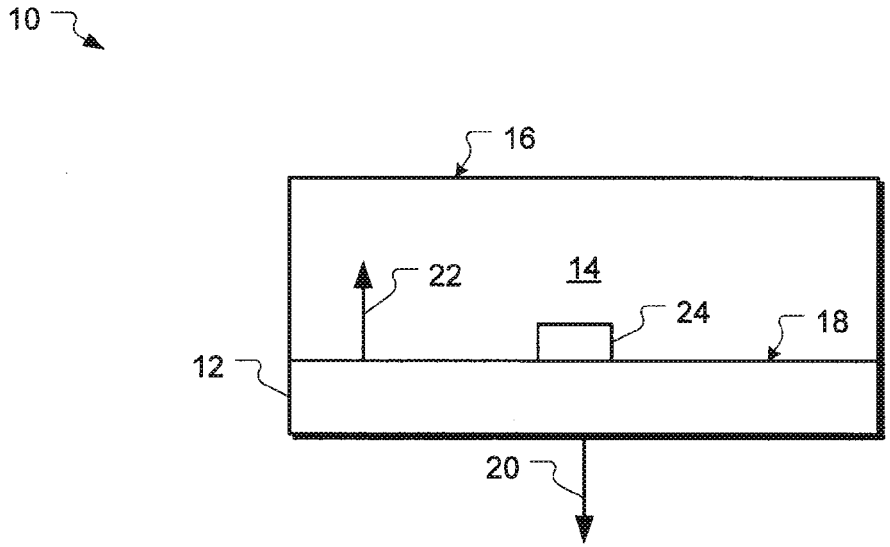
FIG. 1 is a cross-sectional view of a light source according to an embodiment.

FIG. 1 is a cross-sectional view of a light source according to an embodiment. In this embodiment, the light source 10 includes a light emitter 12 configured to generate light 20. The light emitter 12 may also generate heat 22. For example, a light emitter 12 can be an ultraviolet (UV) light emitting diode (LED) array. In another example, the light emitter 12 can be an array of gas discharge lamps. Any device that can generate light can be a light emitter 12.

A heat sink 14 is coupled to the light emitter 12. The heat sink is configured to transfer heat 22 from away from the light emitter 12. In an embodiment, in operation, the light emitter 12 generates the heat 22 as it generates the light 20. However, in some circumstances, a temperature of the light emitter 12 can increase. For example, a light emitter 12 can fail, the heat sink 14 can become detached from the light emitter 12, or the like. In another example, a cooling source, such as a liquid cooling system, a thermoelectric cooler, or the like can fail. As a result a temperature of the light emitter 12 can increase and, at or beyond a threshold temperature, the light emitter 12 can be damaged.

In an embodiment, a temperature sensor 24 is disposed substantially adjacent to the light emitter. As a result, a first thermal time constant associated with the temperature sensor 24 is less than a second thermal time constant associated with a radiation surface 16 of the heat sink 14. For example, the temperature sensor 24 can be mounted in contact with the surface 18 of the light emitter 12. In an embodiment, the temperature sensor 24 can be disposed between the light emitter 12 and the heat sink 14. However, in other embodiments, the temperature sensor 24 can be disposed in other locations, such as on a side of the light emitter 12.

Accordingly, heat would not have to propagate to the opposite radiation surface 16 of the heat sink 14. That is, a time constant of a change in temperature at the radiation surface 16 due to a change in temperature in the light emitter 12 can be greater than a time constant of a change in temperature at the surface 18 of the light emitter 12.

The temperature sensor 24 can be any variety of devices that can sense a temperature. For example, the temperature sensor 24 can be a thermistor, a thermocouple, a diode, a transistor, or any other device that has a temperature dependent characteristic.

Although the temperature sensor can be in contact with the light emitter 12, in an embodiment, the temperature sensor 24 can be disposed within the heat sink. For example, the heat sink 14 can have a substantially continuous surface for interfacing with the light emitter 12. The temperature sensor 24 can be disposed offset from the surface 18 within the heat sink 14. Accordingly, the temperature sensor can still be substantially adjacent to the light emitter 12 and correspondingly have a smaller thermal time constant than a sensor on the radiating surface 16.

Figure 2:
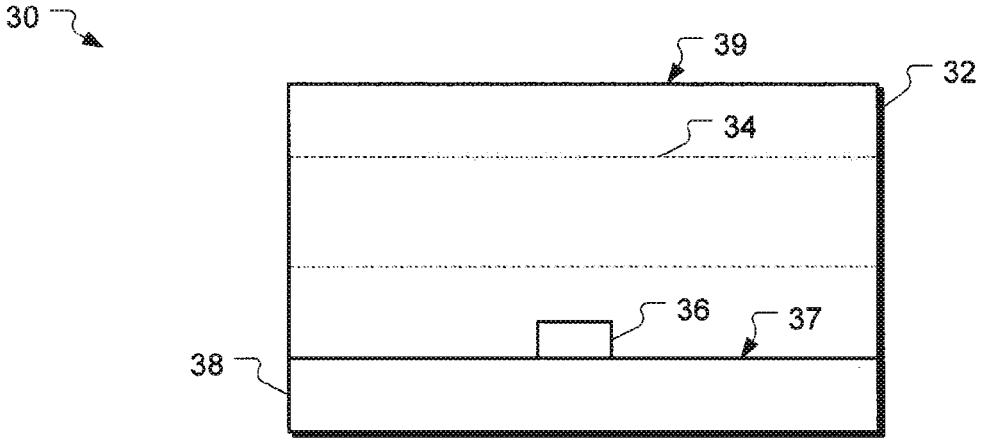
FIG. 2 is a cross-sectional view of a light source with liquid cooling according to an embodiment.

FIG. 2 is a cross-sectional view of a light source with liquid cooling according to an embodiment. In this embodiment, the light source 30 includes a light emitter 38 and a heat sink 32 similar to the light source 10 of FIG. 1. However, the heat sink 32 also includes a liquid cooling system. In this embodiment, a pipe 34 is illustrated passing through the heat sink 32. Water, or some other cooling fluid, can be used to cool the light emitter 38. The temperature sensor 36 is disposed between the pipe 34 and the light emitter 38. Accordingly, the thermal sink of the cooling system can have a reduced impact on the temperature sensitivity of the temperature sensor 36. In contrast, if the temperature sensor was disposed in a radiating surface 39 of the heat sink 32, the cooling system could mask temperature changes in the light emitter 38.

Figure 3:
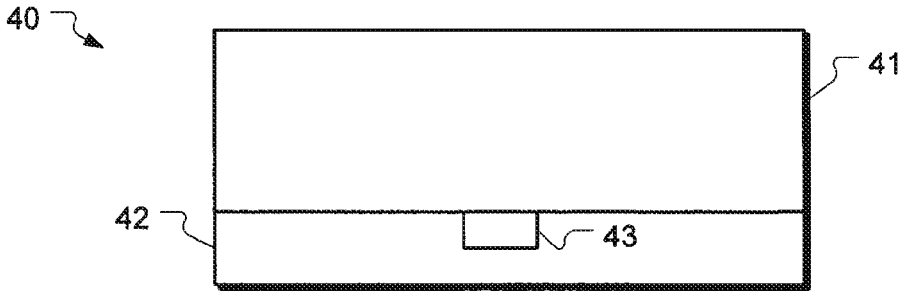
FIG. 3 is a cross-sectional view of a light source with a temperature sensor disposed in a light emitter according to an embodiment.

FIG. 3 is a cross-sectional view of a light source with a temperature sensor disposed in a light emitter according to an embodiment. In this embodiment, the temperature sensor 43 is part of the light emitter 42. For example, the temperature sensor 43 can be a component or circuit of the light emitter 42 that has a temperature dependent characteristic. For example, a threshold voltage, a resistance, a current, or the like of a component can be used to sense the temperature. Since the temperature sensor 43 is part of the light emitter 42, the thermal time constant associated with the temperature sensor 43 can be reduced.

Figure 4:
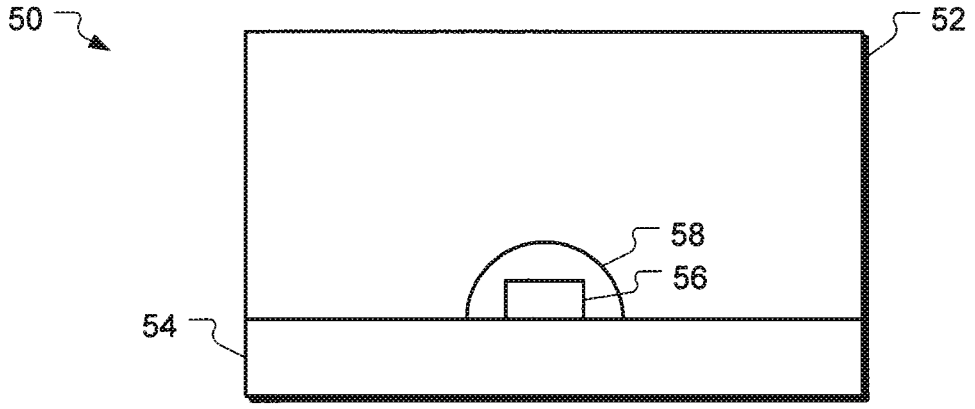
FIGS. 4-6 are cross-sectional views of placement of a temperature sensor in a light source according to some embodiments.
Figure 5:
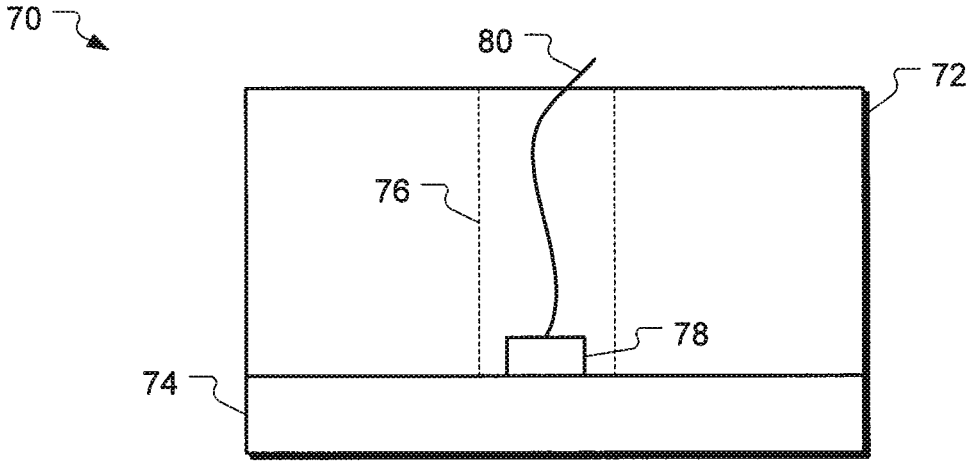
Figure 6:
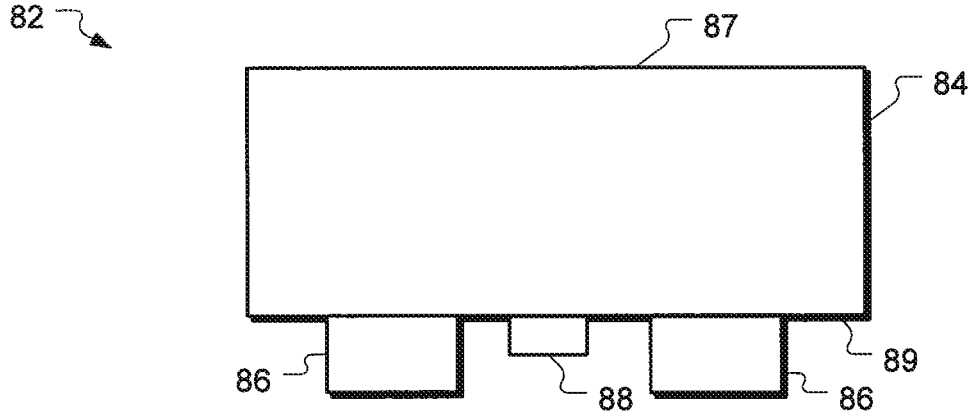

FIGS. 4-6 are cross-sectional views of placement of a temperature sensor in a light source according to embodiments. Referring to FIG. 4, the light source 50 includes a light emitter 54 and a heat sink 52 similar to other light sources described above. However, the temperature sensor 56 is disposed in a channel 58 of the heat sink.

In an embodiment, the channel 58 can be filled with a thermally conductive compound, such as a thermally conductive paste, a metallic epoxy, or the like. Accordingly, the heat sink 52 can still make thermal contact with the light emitter 54.

In an embodiment, the channel 58 can be substantially obscured by the light emitter. That is, the channel 58 can be open on the heat sink, yet when the heat sink 52 is assembled with the light emitter 54, the channel is substantially obscured.

In an embodiment, the channel 58 can be substantially filled with a thermally insulating substance. For example, an air gap, or other insulating substance can substantially surround the temperature sensor 56. However, the temperature sensor 56 can still be in thermal contact with the light source 54. As a result, the thermal mass of the heat sink 52 in the local region can have a reduced impact on the thermal time constant associated with the temperature sensor 56.

Referring to FIG. 5, in an embodiment, the light source 70 can include an opening 76 that can be disposed in the heat sink to allow access to the temperature sensor. For example, wires 80 can extend through the opening. In an embodiment, the opening 76 can be disposed such that the opening does not penetrate a cooling system, such as the pipe 34 of FIG. 2. Moreover, although he opening 76 is illustrated as extending substantially perpendicular to a plane of the light emitter 74, the opening 76 can extend in different directions.

Referring to FIG. 6, in an embodiment, the light source 82 can include light emitters 86 that can be mounted directly on the heat sink 84. A temperature sensor 88 can also be mounted on the heat sink 84. In particular, the light emitters 86 and the temperature sensor 88 can be mounted on a surface 89 on an opposite side of a radiating surface 87 of the heat sink 84. As the temperature sensor 88 can be closer to the light emitter 86 than the radiating surface of the heat sink 87, the temperature sensor 88 can be more responsive to temperature changes in of the light emitters.

Although in the above examples, a single temperature sensor has been described, any number of temperature sensors can be used. For example, a single temperature sensor can be used for an entire light source. In another example, each light emitter of a light source can have an associated temperature sensor.

Figure 7:
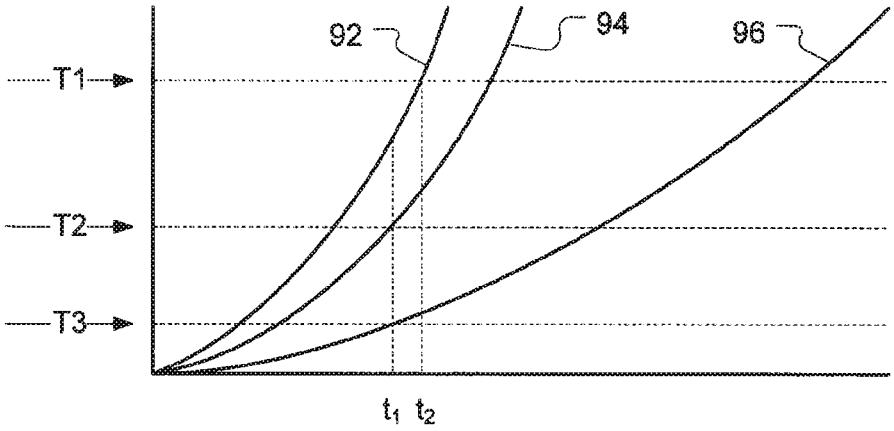
FIG. 7 is a chart illustrating temperature at various locations on a light source according to an embodiment.

FIG. 7 is a chart illustrating temperature at various locations on a light source according to an embodiment. The chart illustrates the time dependence of temperatures. An increasing temperature of a light emitter is illustrated with curve 92. A time dependence of a sensed temperature at a temperature sensor that is substantially adjacent to the light emitter is represented by curve 94. Similarly, a temperature sensor that is further from the light emitter, for example, on a radiating surface of a heat sink as described above, is represented by curve 96.

Temperature T1 represents a temperature at which damage can occur to the light emitter. Temperature T2 is a temperature threshold of a temperature sensor as described above, above which the light emitter can be shut down. In this embodiment, the threshold can be selected such that the actual temperature of the light emitter is less than the damage temperature T1 to accommodate any overshoot.

To achieve the same indication with a temperature sensor with an increased thermal time constant, a lower threshold temperature, illustrated by temperature T3, is necessary. Accordingly, at the same time t1, the light emitter can be shut down so that the temperature does not teach temperature T1. However, for a given temperature sensing sensitivity, a lower threshold results in a larger margin of error. That is, a higher thermal time constant results in a longer time to cross the threshold considering the measurement error. With a lower thermal time constant, the decision to shut down the light emitter can be made earlier.

Figure 8:
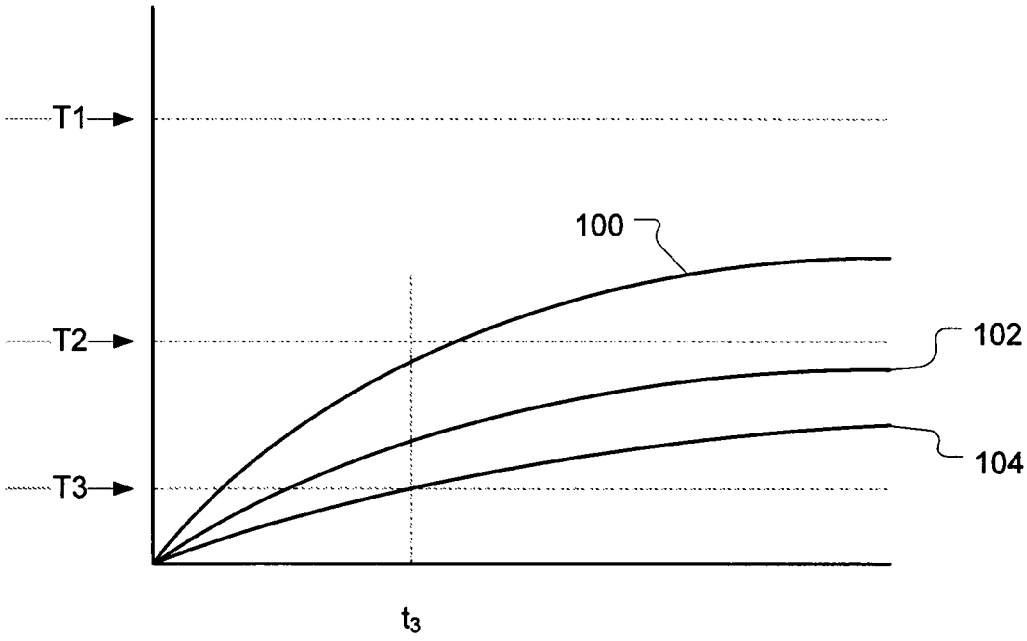
FIG. 8 is another chart illustrating temperature at various locations on a light source according to an embodiment.

FIG. 8 is another chart illustrating temperature at various locations on a light source according to an embodiment. In this embodiment, a transition to steady state temperatures is illustrated. In the steady state, a temperature difference can be present between the light emitter temperature 100, a temperature 102 of a lower thermal time constant temperature sensor, and a temperature 104 of a higher thermal time constant temperature sensor. In particular, the temperature difference can be a function of the distance from the heat source, namely the light emitter.

In this embodiment, the light source temperature 100 can reach a steady state that is below the damage temperature T1. The temperature sensor temperature 102 can remain below the threshold T2. In contrast, even through the temperature sensor temperature 104 can reach a lower steady state, the lower threshold necessary due to the higher thermal time constant can limit the temperature of the light emitter unnecessarily. As a result, a maximum temperature of operation that is below the damage threshold can be limited because the threshold temperature T3 is lowered to accommodate the slower transient response as described with respect to FIG. 6. That is, the light emitter temperature 100 can be limited to less than what the light emitter could otherwise operate due to the transient response thresholds described above.

Figure 9:
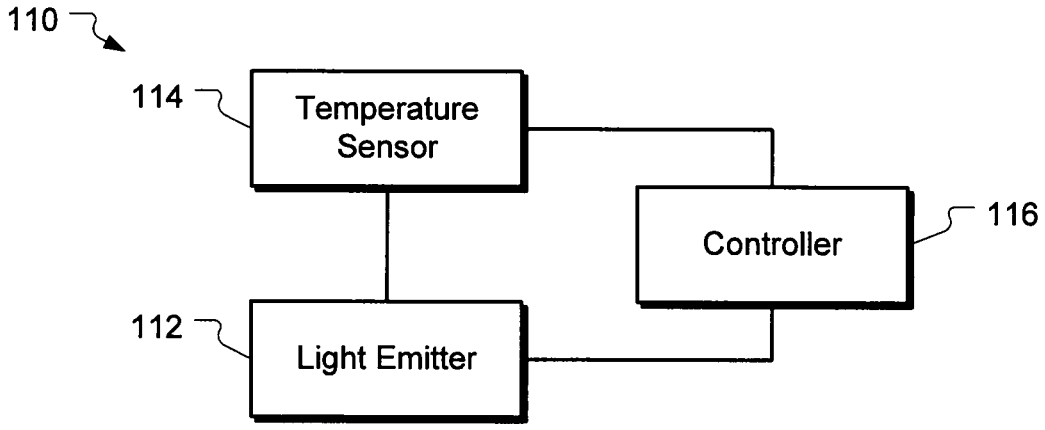
FIG. 9 is a block diagram of a temperature monitor and control system according to an embodiment.

FIG. 9 is a block diagram of a temperature monitor and control system according to an embodiment. In this embodiment, the system 110 includes a temperature sensor 114 coupled to a light emitter 112. A controller 116 is coupled to the temperature sensor 114 and the light emitter 112. The controller is configured to control the light emitter 112 in response to the temperature sensor 114.

The controller 116 can be can include a processor or processors such as digital signal processors, programmable or non-programmable logic devices, microcontrollers, application specific integrated circuits, state machines, or the like. The controller 116 can also include additional circuitry such as memories, input/output buffers, transceivers, analog-to-digital converters, digital-to-analog converters, or the like. In yet another embodiment, the controller 116 can include any combination of such circuitry. Any such circuitry and/or logic can be used to implement the controller 116 in analog and/or digital hardware, software, firmware, etc., or any combination thereof.

In an embodiment, the controller 116 can be configured to sense that a temperature sensed by the temperature sensor 114 passes a threshold temperature and in response, disable light emitter. For example, the temperature T2, described above, can be the threshold temperature. In another embodiment, the controller 116 can be configured to control the light emitter 112 to perform other actions in response to the temperature. For example, if the temperature sensor 114 indicates that the temperature has passed a threshold temperature, the controller 116 can be configured to reduce a drive level of the light emitter 112.

As described above, a threshold temperature can be used to control operation of the light emitter 112. However, other aspects of temperature can be used by the controller 116. In an embodiment, the controller 116 can be configured to determine a rate of temperature change in response to the temperature sensor 114. The controller can be configured to disable the light emitter 112 in response to the rate of temperature change. For example, as described above, the light emitter 112 can be operating at a higher temperature than is still less than a threshold for damage. The rate of temperature change can be used to determine if that higher temperature is merely a higher steady state, or a potential failure. That is, in an embodiment, the rate of temperature change can be combined with the temperature measurement to control the operation of the light emitter. Since the temperature sensor 114 can have a lower thermal time constant, more sensitivity can be obtained for the rate of temperature change, similar to the increased sensitivity for the temperature measurement described above.

Although particular embodiments have been described, it will be appreciated that the principles of the invention are not limited to those embodiments. Variations and modifications may be made without departing from the principles of the invention as set forth in the following claims.

The invention claimed is:

1. A light source, comprising:

a light emitter;

a heat sink comprising a liquid cooling system, the heat sink having a radiation surface and a surface on an opposite side of the heat sink from the radiation surface, the surface on the opposite side of the heat sink from the radiation surface interfacing with a surface of the light emitter;

a temperature sensor mounted in contact with the surface of the light emitter, the temperature sensor disposed within the heat sink between the liquid cooling system and the light emitter; and an opening in the heat sink, the opening formed as a channel extending through the heat sink from the radiation surface to the surface on the opposite side of the heat sink from the radiation surface, the opening exposing and allowing access to the temperature sensor at the radiation surface, wherein a first thermal time constant associated with the temperature sensor is less than a second thermal time constant associated with the radiation surface of the heat sink.

2. The light source of claim 1, wherein:

the opening in the heat sink exposing the temperature sensor is disposed such that it does not penetrate the liquid cooling system.

3. The light source of claim 1, further comprising:

a controller coupled to the temperature sensor and configured to control the light emitter in response to the temperature sensor.

4. The light source of claim 3, wherein the controller is configured to sense that a temperature sensed by the temperature sensor passes a threshold temperature and in response, disable the light emitter.

5. The light source of claim 3, wherein the controller is configured to determine a rate of temperature change in response to the temperature sensor and disable the light emitter in response to the rate of temperature change.

6. A method of operating a light source, comprising:

sensing a temperature via a temperature sensor at a location substantially adjacent to a light emitter;

determining a rate of temperature change in response to the sensed temperature; and controlling an operation of the light emitter in response to the rate of temperature change at the location;

wherein a first thermal time constant associated with the location is less than a second thermal time constant associated with a radiation surface of a heat sink coupled to the light emitter, wherein a surface on an opposite side of the heat sink from the radiation surface interfaces with a surface of the light emitter, wherein the heat sink is cooled via a liquid cooling system, wherein the temperature sensor is disposed within the heat sink between the liquid cooling system and the light emitter, and wherein an opening is formed as a channel extending through the heat sink from the radiation surface to the surface on the opposite side of the heat sink from the radiation surface, the opening exposing and allowing access to the temperature sensor at the radiation surface.

7. The method of claim 6, further comprising:

determining that a temperature of the light emitter has exceeded a threshold in response to the rate of temperature change and the sensed temperature; and controlling the operation of the light emitter in response to the rate of temperature change.

8. A light source comprising:

a light emitter;

a heat sink coupled to the light emitter and having a radiation surface and a continuous surface on an opposite side of the heat sink from the radiation surface which interfaces with a surface of the light emitter, the heat sink further comprising a liquid cooling system; and a temperature sensor substantially adjacent to the light emitter, and coupled to the surface of the light emitter, the temperature sensor disposed within the heat sink;

wherein an opening in the heat sink is disposed outside of the liquid cooling system, the opening formed as a channel extending through the heat sink from the radiation surface of the heat sink to the surface on the opposite side of the heat sink from the radiation surface, the opening exposing and allowing access to the temperature sensor at the radiation surface.

9. The light source of claim 8, wherein a first thermal time constant associated with the temperature sensor is less than a second thermal time constant associated with the radiation surface of the heat sink.

10. The light source of claim 8, wherein the opening extends in a direction different than substantially perpendicular to a plane of the light emitter.

11. The light source of claim 8, further comprising a controller coupled to the temperature sensor and the light emitter, the controller configured to control the light emitter in response to the temperature sensor.

12. The light source of claim 8, wherein the liquid cooling system comprises a pipe passing through the heat sink, the temperature sensor disposed between the pipe and the light emitter.

13. The Light source of claim 8, wherein at least one wire extends through the opening in the heat sink.

* * * * *